US005620627A

United States Patent [19]

Keller et al.

[11] Patent Number: 5,620,627

[45] Date of Patent: Apr. 15, 1997

[54] DISCHARGE ASSEMBLY AND STATOR AND ROTOR MEMBERS THEREOF WITH TWO PART CONSTRUCTION

[75] Inventors: Werner Keller, Steinhausen; Rolf Waltenspühl, Hünenberg, both of Switzerland

[73] Assignee: Stoping AG, Baar, Switzerland

[21] Appl. No.: 502,065

[22] Filed: Jul. 14, 1995

[30] Foreign Application Priority Data

Jul. 22, 1994 [CH] Switzerland ..... 02 326/94

[51] Int. Cl.[6] ..... B22D 41/08

[52] U.S. Cl. ..... 222/598; 222/599

[58] Field of Search ..... 222/591, 598, 222/599, 597, 590; 266/236

[56] References Cited

U.S. PATENT DOCUMENTS 5,085,356 2/1992 Waltensphul ..... 222/598
5,145,634 9/1992 Hintzen ..... 222/598
5,230,813 7/1993 Hintzen ..... 222/599

FOREIGN PATENT DOCUMENTS 4032084 5/1992 Germany .
004301329 7/1994 Germany ..... 222/598

*Primary Examiner*—Scott Kastler
*Attorney, Agent, or Firm*—Wenderoth, Lind & Ponack

[57] ABSTRACT

A discharge assembly for controlling the discharge of molten metal from a vessel includes a stator member mounted to extend through the vessel and a rotor member coupled to the stator member to be rotatable relative thereto. A lateral opening in the rotor member is brought into and out of alignment with a lateral opening in the stator member, thereby opening communication to a longitudinal discharge passage through the stator member. One of the members has a projection fitting into a recess in the other member, with complementary sliding sealing surfaces therebetween. The projection comprises an insert formed separately from the respectively member and fixed thereto to be non-rotatable relative thereto.

32 Claims, 3 Drawing Sheets

DISCHARGE ASSEMBLY AND STATOR AND ROTOR MEMBERS THEREOF WITH TWO PART CONSTRUCTION

BACKGROUND OF THE INVENTION

The present invention relates to a discharge assembly for controlling the discharge of material from a vessel, and to stator and rotor members employed to form such assembly. The present invention particularly relates to such discharge assembly and stator and rotor members formed of fireproof refractory ceramic material for controlling the discharge of molten metal from a metallurgical vessel. The present invention still further relates to such assembly and members wherein one of the members includes a structure forming a sliding seal with the other member, particularly by a cylindrical sliding surface, and further particularly by an exterior cylindrical sliding surface.

In such assembly, the stator member is an elongated member mounted to extend through the wall of the vessel and has therein a central longitudinal discharge passage opening at an outlet exterior of the vessel. An inlet end of the stator member has therethrough at least one lateral opening. The rotor member extends into the interior of the vessel and has an inner end having therethrough at least one lateral opening. The inner end of the rotor member is coupled to the inlet end of the stator member so that the rotor member is movable axially and/or rotatably relative to the stator member to bring the respective lateral openings thereof into and out of alignment, thereby to control the discharge of molten metal through the assembly.

DE-C1 40 32 084 discloses such an assembly of fireproof refractory ceramic sealing stator and rotor members. The stator member is embedded in and extends through the wall of a metallurgical vessel, for example to contain molten steel. The rotor member is arranged along the same axis of the stator member and extends upwardly out of the vessel. The inner end of the rotor member has a projection fitting into a cylindrical recess of the stator member. Complementary surfaces of the two members thus form sliding sealing surfaces, for example cylindrical sliding sealing surfaces. In principle, the rotor member could have therein the cylindrical opening or recess into which extends a cylindrical projection of the stator member. A drive rod interlocks with the rotor member and extends upwardly from the vessel and is coupled to a rotational drive device. Rotation of the rotor member by the drive device rotates the rotor member relative to the stator member such that lateral openings in the two members can be brought into and out of alignment, thereby controlling the discharge of molten steel from the vessel. Such vessel, for example a tundish, or other discharge or distribution vessel, may be employed for continuous casting, such that the outlet end of the stator member is submerged in molten steel in a casting mold and discharges molten steel thereinto. Thereby, the molten steel is protected from ambient air and surrounding atmosphere. In such known arrangement, the stator and rotor members are fireproof refractory ceramic members and are made from particular such materials. The formation of such members requires relatively expensive molds for their manufacture to be able to produce the members with sufficient precision, particularly at the complementary sliding sealing surfaces.

SUMMARY OF THE INVENTION

Accordingly, it is an object of the present invention to provide an improved discharge assembly and stator and rotor members thereof of the above type, but whereby it is possible to overcome the above and other prior art disadvantages.

It is a further object of the present invention to provide such a discharge assembly and stator and rotor members thereof that can be manufactured simply and thus economically and having the same or improved durability compared to such members of the prior art.

These objects are achieved in accordance with the present invention by the provision that the stator or rotor member having the projection defining the exterior sliding sealing surface is formed of a two part construction. Particularly, the projection comprises an insert formed separately from the stator or rotor member and fixed thereto. Such insert at least in part forms the exterior sliding surface of the corresponding member. Very advantageously, such insert is in the form of the cylindrical sliding surface that forms a sealing sliding contact with the complementary surface of the other member.

With this constructional arrangement in accordance with the present invention, it is easier to manufacture the respective member than when such member is designed as one piece, as is done in the prior art. In manufacturing such refractory ceramic sealing part, fine grain ceramic material is usually filled into a mold, pressed therein and subsequently baked or fired in an oven to harden the molded part. Through the two part construction in accordance with the present invention, it is possible to significantly simplify the molds necessary for the manufacturing process. In addition, the insert can be worked very easily on the outer cylindrical sliding surface thereof before assembly with the other part of the respective member, thereby facilitating formation of such sliding surface with good sealing characteristics.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
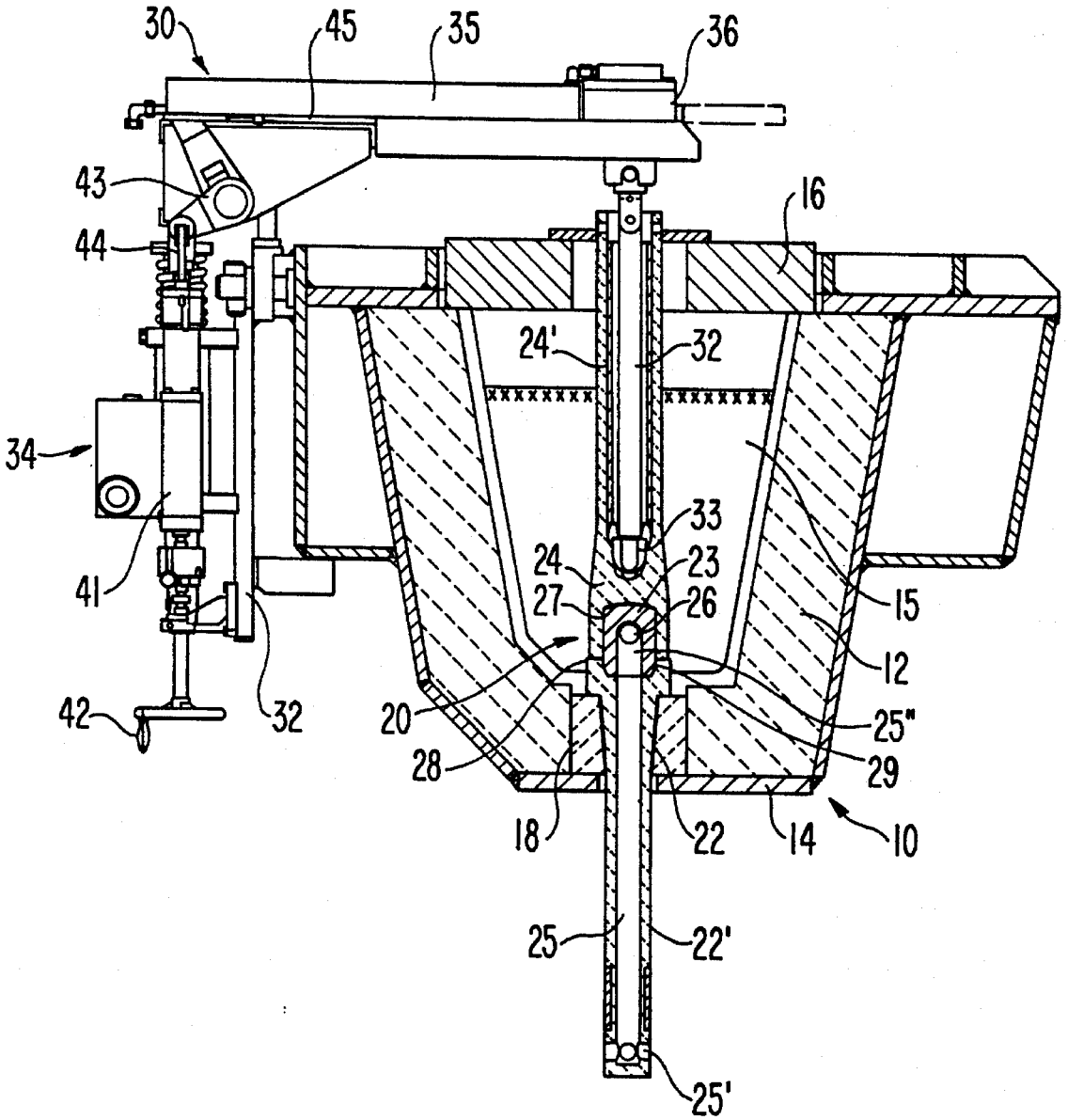
FIG. 1 is a longitudinal sectional view through a vessel incorporating a discharge assembly in accordance with one embodiment of the present invention, wherein the stator member is formed of a novel two part construction.

In FIG. 1 is shown, somewhat schematically, a metallurgical vessel 10 containing molten metal 15. Vessel 10 includes a steel mantle or outer jacket 14 and a fireproof refractory ceramic lining 12 walled into mantle 14. A removable cover 16 covers the top of vessel 10, whereby molten metal 15 is sealed from the exterior atmosphere. A perforated brick 18 extends through the bottom of lining 12, thereby forming a discharge embedded in lining 12.

A discharge assembly for controlling the discharge of molten metal 15 from vessel 10 comprises a stator member 22 extending through brick 18 in a normal manner, for example by being cemented therein, and a rotor member 24 sealingly coupled with stator member 22 to define a seal 20 therebetween and to be rotatable relative thereto. The illustrated stator member 22 extends from the inside of vessel 10 through brick 18 to a discharge end 22' of the type intended to achieve submerged casting, i.e. to extend into a casting mold or die (not shown) and to be submerged in molten metal discharged thereinto. It is of course contemplated that the present invention could encompass a stator member wherein the discharge end 22' could be formed separately from and connected to the stator member 22. Part 22' has at the bottom thereof at least one discharge opening 25' forming an outlet. The illustrated arrangement contemplates four such openings 25'. The part 22' further can include a slag protecting outer area or sheath. The opening or openings 25' extend from a central longitudinal discharge passage 25. The inlet end of stator member 22 has therethrough at least one transverse or lateral opening 26 opening into discharge passage 25. Thus, molten metal allowed by rotor member 24 to enter lateral opening 26 passes downwardly through discharge passage 25 and exits outlet openings 25' into a mold, for example a continuous casting mold.

Rotor member 24 extends substantially vertically upwardly from stator member 22 and is coupled rotatably therewith. Rotor member 24 extends through cover 16. The longitudinal axis of rotor member 24 generally is concentric to that of stator member 22. Rotor member 24 has therein a longitudinal passage 24' into which extends a driving rod 32 that is coupled at an upper end thereof to a drive unit 30. At the lower end of passage 24' is a recess of a suitable non-circular configuration, for example polygonal configuration, into which fits a complementary head 33 of drive rod 32. This enables the drive rod 32 to interlock with the stator member 24 in the rotational direction and thus rotates rotor member 24 upon rotation of the drive rod. Polygonal head 33 is designed so that drive rod 32 can tilt several degrees relative to the axis of rotor member 24. Thus, it is ensured that the rotor member and the drive rod do not need to align precisely after mounting of the vessel, while a still perfect transfer of rotational movement is guaranteed. The inner end of rotor member 24 has at least one lateral or transverse opening corresponding to opening 26 of stator member 22 and that can be selectively and controllably brought into and out of alignment therewith, thereby communicating molten metal from the interior of the vessel through such aligned openings into discharge passage 25.

In FIG. 1, the coupling of the stator and rotor members is achieved by a projection of the stator member, through which extends lateral opening 26, extending into a recess in rotor member 24. The projection includes a sliding surface 27, particularly a cylindrical sliding surface to form a seal with a complementary surface of rotor member 24. In particularly accordance with the present invention, the projection is in the form of a fireproof refractory ceramic insert 23 that is formed separately from the remainder of stator member 22 and that is fixed thereto to be not rotatable relative thereto, in a manner to be discussed in more detail below. Insert 23 has therein a longitudinal passage 25" into which extends lateral opening 26 and which is coaxial with discharge passage 25 and which opens thereinto. Preferably, insert 23 fits into an indentation or recess 29 in the upper end of the remainder of the stator member 22 and is fixed therein against relative rotary movement in the above mentioned manner to be discussed in more detail below.

By the novel arrangement of the present invention wherein the stator member having the projection is of a two part construction, wherein the projection is a separate part formed separately and fixed to the remaining part of the stator member, such parts can be manufactured very simply from relatively simple molds and pressed and fired and then subsequently mortared together. The separate formation furthermore enables either of the parts to be replaced when necessary, with the other part still being usable.

Drive unit 30 functions generally in a known manner. Unit 30 includes a carrier or support 32 attached to the side of vessel 10, a linear sliding element 34 arranged vertically on support 32, and a boom arm 35 extending from the top of element 34 horizontally over the top of the vessel. The drive rod 32 is connected with a rotatable portion 36 at the end of arm 35 to enable rotation of drive rod 32 and rotor member 24. Element 34 is configured to enable automatic operation, for example by a piston/cylinder unit 41 having an appropriate control unit (not shown) or hand operation by means of a hand wheel 42. Linear movement imparted to a lifting rod 44 of unit 41 causes a lever rod assembly 43 to turn in horizontal movement, for example by rack 45 in arm 35. Rack 45 can cause rotation of part 36. The end result is that the drive unit enables selective rotation of rotor member 24, and also can achieve longitudinal axial movement thereof.

Figure 2:
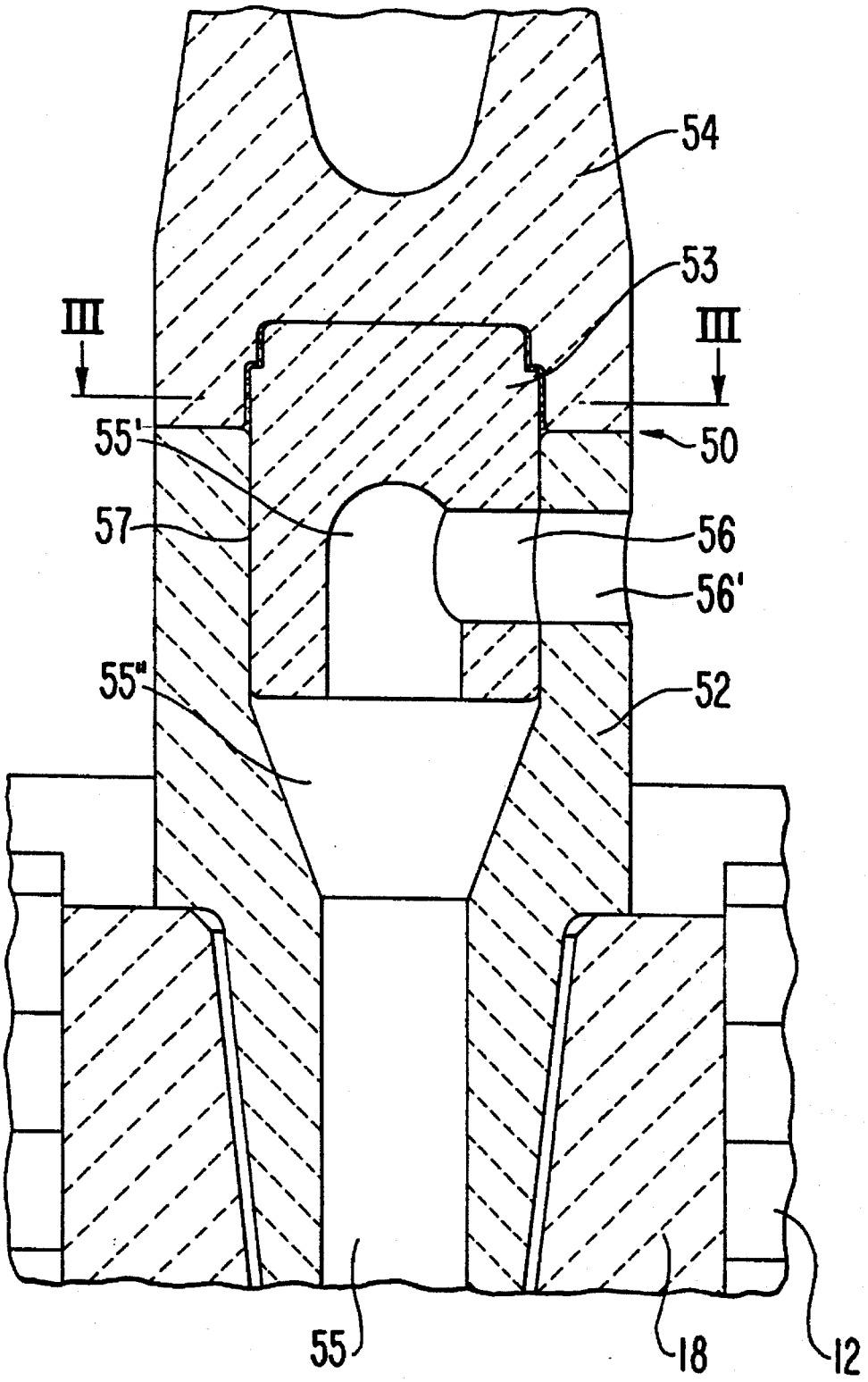
FIG. 2 is an enlarged, partial longitudinal sectional view illustrating an assembly in accordance with another embodiment of the present invention, wherein the rotor member is of the novel two part construction.
Figure 3:
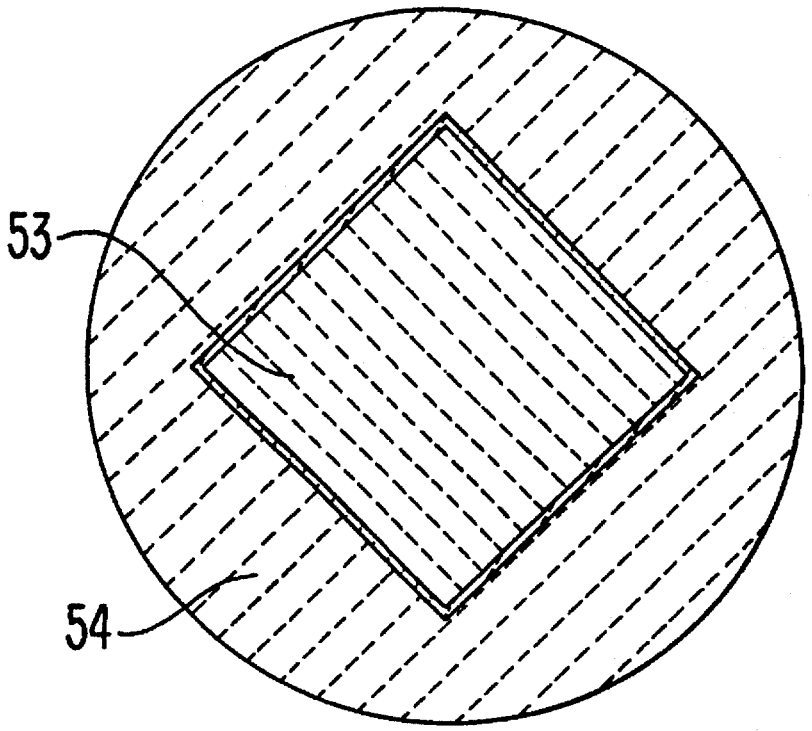
FIG. 3 is a transverse cross sectional view taken along line III—III of FIG. 2.

In the embodiment of FIGS. 2 and 3, it is fireproof refractory ceramic rotor member 54 that has the projection in the form of a fireproof refractory ceramic insert 53 extending into a recess in the upper end of stator member 52 and defining an exterior cylindrical sliding surface 57 forming a seal with a complementary surface of stator member 52. Insert 53 has therein a longitudinal passage 55' to open into an enlarged portion 55" at the top end of longitudinal discharge passage 55 of stator member 52. The upper end of stator member 52 has therethrough a lateral opening 56'. Thus, rotation of rotor member 54 relative to stator member 52 enables opening 56 of rotor member 54 controllably and selectively to be brought into and out of alignment with opening 56'. Longitudinal passage 55' as illustrated has a closed upper end, but could be formed continuously through insert 53. This arrangement similarly forms a seal 50, in a manner similar to that in the embodiment of FIG. 1.

FIGS. 2 and 3 illustrate the manner of non-rotatably fixing the insert to the other portion of the rotor member. The same arrangement of fixing can be employed in the embodiment of FIG. 1. Thus, the insert and the other portion of the rotor member can be provided with complementary non-circular configurations, for example polygonal configurations, as shown in FIG. 3. Further, the insert can be cemented in a recess or indentation in the respective member.

As shown in FIG. 2, rotor member 54 is supported axially by complementary planar annular surfaces extending outwardly from the periphery of insert 53. In this manner, the position of the rotor member relative to the stator member in the axial direction is defined automatically, and consequently the relative position of openings 56, 56' axially also is defined automatically. Enlargement 55" is funnel shaped, so that a gap is formed between the lower end of insert 53 and the stator member 52, within which molten metal can proceed and can lead to a damping of the rotor member. Plural lateral openings, for example two or four such openings, could be provided. The insert 23, 53 advantageously is formed of a highly fireproof material and/or a highly wear resistant material, since the sliding surface of the insert is subjected to a greater degree of wear than the remaining part of the respective member.

It is contemplated, in accordance with the present invention, that both the stator member and rotor member could be provided with respective fireproof inserts.

Although the present invention has been described and illustrated with respect to preferred features thereof, it is to be understood that various changes and modifications may be made thereto, as would be understood by one of ordinary skill in the art, without departing from the scope of the present invention.

We claim:

1. A discharge assembly for controlling the discharge of material from a vessel, said assembly comprising:

a stator member to be mounted to extend through the vessel, said stator member having therein a longitudinal discharge passage, a lateral opening extending through an inlet end of said stator member to be within the vessel, and an outlet leading from said discharge passage at a location to be outwardly of the vessel;

a rotor member having a lateral opening extending through a portion thereof to be positioned within the vessel;

one of said inlet end of said stator member and said portion of said rotor member having therein a recess defining an interior sliding surface;

the other of said portion of said rotor member and said inlet end of said stator member having extending therefrom a projection defining an exterior sliding surface;

said rotor member being rotatably mounted to said stator member with said projection extending into said recess with said interior sliding surface confronting said exterior sliding surface, whereby rotational or axial movement of said rotor member relative to said stator member enables said lateral opening of said rotor member to be brought into or out of alignment with said lateral opening of said stator member, thus controlling discharge of material in the vessel through said lateral openings, said discharge passage and said outlet;

said projection comprising an insert formed separately from said other of said portion of said rotor member and said inlet end of said stator member and fixed thereto; and said lateral opening of said other of said portion of said rotor member and inlet end of said stator member extending through said insert.

2. An assembly as claimed in claim 1, for controlling the discharge of molten metal from a metallurgical vessel, wherein said stator and rotor members are formed of ceramic materials.

3. An assembly as claimed in claim 1, wherein said insert is formed of wear resistant refractory ceramic material.

4. An assembly as claimed in claim 1, wherein said sliding surfaces are cylindrical.

5. An assembly as claimed in claim 4, wherein said sliding surfaces are in sealingly sliding contact.

6. An assembly as claimed in claim 1, wherein said sliding surfaces are in sealingly sliding contact.

7. An assembly as claimed in claim 1, wherein said insert is non-rotatably fixed to said other of said portion of said rotor member and said inlet end of said stator member.

8. An assembly as claimed in claim 7, wherein said fixing is achieved by confronting non-circular surfaces.

9. An assembly as claimed in claim 7, wherein said fixing is achieved by complementary polygonal shapes.

10. An assembly as claimed in claim 1, wherein said projection is cemented in position.

11. An assembly as claimed in claim 1, wherein said insert is fixed to said stator member.

12. An assembly as claimed in claim 11, wherein said insert has therein a longitudinal passage that is aligned coaxially with said discharge passage, and said lateral opening of said stator member extends outwardly from said longitudinal passage.

13. An assembly as claimed in claim 1, wherein said insert is fixed to said rotor member.

14. An assembly as claimed in claim 13, wherein said insert has therein a longitudinal passage that is aligned coaxially with and opens into said discharge passage, and said lateral opening of said rotor member extends outwardly from said longitudinal passage.

15. A stator member to be mounted to extend through a vessel and to be assembled with a rotor member to form a discharge assembly for controlling the discharge of material from the vessel, said stator member comprising:

a longitudinal discharge passage;

an inlet end having extending therethrough a lateral opening and to be within the vessel;

an outlet leading from said discharge passage at a location to be outwardly of the vessel;

said inlet end having extending therefrom a projection defining an exterior sliding surface and to be extended into a recess in the rotor member with said exterior sliding surface confronting a complementary surface of the rotor member, whereby movement of the rotor member would enable a lateral opening thereof to be brought into and out of alignment with said lateral opening of said inlet end;

said projection comprising an insert formed separately from said inlet end and fixed thereto; and said lateral opening extending through said insert.

16. A stator member as claimed in claim 15, formed of ceramic material.

17. A stator member as claimed in claim 15, wherein said insert is formed of wear resistant refractory ceramic material.

18. A stator member as claimed in claim 15, wherein said exterior sliding surface is cylindrical.

19. A stator member as claimed in claim 15, wherein said insert is non-rotatably fixed to said inlet end.

20. A stator member as claimed in claim 19, wherein said fixing is achieved by confronting non-circular surfaces.

21. A stator member as claimed in claim 19, wherein said fixing is achieved by complementary polygonal shapes.

22. A stator member as claimed in claim 15, wherein said insert is cemented to said inlet end.

23. A stator member as claimed in claim 15, wherein said insert has therein a longitudinal passage that is aligned coaxially with said discharge passage, and said lateral opening extends outwardly from said longitudinal passage.

24. A rotor member to be assembled with a stator member to form a discharge assembly for controlling the discharge of material from a vessel, said rotor member comprising:

an element having a portion to be positioned within the vessel and having extending therethrough a lateral opening;

said element having extending therefrom a projection defining an exterior sliding surface and to be extended into a recess in the stator member with said exterior sliding surface confronting a complementary surface of the stator member, whereby movement of said rotor member would enable said lateral opening to be brought into and out of alignment with a lateral opening of the stator member;

said projection comprising an insert formed separately from said element and fixed thereto; and said lateral opening extending through said insert.

25. A rotor member as claimed in claim 24, formed of ceramic material.

26. A rotor member as claimed in claim 24, wherein said insert is formed of wear resistant refractory ceramic material.

27. A rotor member as claimed in claim 24, wherein said exterior sliding surface is cylindrical.

28. A rotor member as claimed in claim 24, wherein said insert is non-rotatably fixed to said element.

29. A rotor member as claimed in claim 28, wherein said fixing is achieved by confronting non-circular surfaces.

30. A rotor member as claimed in claim 28, wherein said fixing is achieved by complementary polygonal shapes.

31. A rotor member as claimed in claim 24, wherein said insert is cemented to said element.

32. A rotor member as claimed in claim 24, wherein said insert has therein a longitudinal passage, and said lateral opening extends outwardly from said longitudinal passage.

* * * * *